United States Patent [19]

Stroud et al.

[11] Patent Number: 4,865,094

[45] Date of Patent: Sep. 12, 1989

[54] LONG LOG WAFERIZER

[75] Inventors: Brian T. Stroud, Richmond; Jack Weavell, Coquitlam; Cameron D. Mierau, Clearbrook, all of Canada

[73] Assignee: Cae Machinery Ltd., Vancouver, Canada

[21] Appl. No.: 261,083

[22] Filed: Oct. 24, 1988

[51] Int. Cl.[4] ..... B27C 1/10

[52] U.S. Cl. ..... 144/176; 144/162 R; 144/242 R; 144/242 A; 144/356; 144/370; 241/285 A

[58] Field of Search ..... 241/285 A; 144/162 R, 144/176, 172, 356, 359, 370, 242 R, 242 A

[56] References Cited

U.S. PATENT DOCUMENTS 4,736,781 4/1988 Morey et al. ..... 144/241

4,736,897 4/1988 Reemet et al. ..... 241/285 A

*Primary Examiner*—W. Donald Bray

*Attorney, Agent, or Firm*—Fulwider, Patton, Rieber, Lee & Utecht

[57] ABSTRACT

A long log waferizer for converting logs into wafers comprising a base, with a reciprocating hydraulic cylinder for controlling a wheeled movable frame adapted for linear reciprocating movement on the base. A motor is mounted to the movable frame to drive a rotary cutter that is also mounted to the movable frame. A log delivery chute adapted to direct logs in front of the rotary cutter is provided and the movable frame is moved by the hydraulic cylinder to advance the rotary cutter into the logs, the rotary cutter cutting the logs into wafers.

20 Claims, 6 Drawing Sheets

18
20
40
43
42
41
39
45
7
7
15
16
8
32
108
115
102
62
110
33
35
107
104
114
60
106
100
126
113
122
121
125
123
120
66
52
10
53
63
4

LONG LOG WAFERIZER

FIELD OF THE INVENTION

This invention relates to a long log waferizer for transforming a log or a series of logs or other pieces of randomly sized wood into wafers or strands of a predetermined size and shape.

BACKGROUND OF THE INVENTION

Waferizing apparatus, that is apparatus to produce wafers from logs for use in the production of wafer board, are extremely well known. They resemble wood chippers in appearance but differ in the product they are designed to produce. Chippers cut wood across the grain to produce chips for the production of wood pulp. Waferizers cut the wood substantially parallel to the grain to produce wafers or flakes for the manufacture of waferboard and its derivatives.

In the past, waferizing apparatus has generally comprised a large rotating cutting disc or drum mounted on a driven shaft. The disc or drum has openings formed in it. On one surface is mounted a carrier for the waferizing knives which are disposed in the openings of the passageways. The knives are held in position by clamps contacting the planar surface of the knives. Clamps are usually held in place by bolting through into a threaded insert located within a recess in the carrier, on the surface of the carrier remote from the clamps. The knife typically has a counter knife disposed beneath it, that is against the carrier, and the knife and counter knife are bolted in position. Applicant's U.S. Pat. No. 4,685,497 is indicative of the prior art for its showing of a conventional arrangement of a rotary cutting disc.

While variations of this rotary cutter occur, prior art chipping or waferizing apparatus relies almost exclusively on an arrangement wherein the rotating cutting disc or drum is mounted to an immovable base and logs are advanced into the rotating cutting blade at an appropriate orientation. As the disc or drum rotates the knives, which project from the outer surface of the cutting element beyond the clamps and the carrier, cut through the logs pressed against the carrier. Examples of such prior art devices include U.S. Pat. No. 3,346,027 to Kirsten in which logs are advanced against a rotating disc having cutting knives by a feed system comprising a hydraulic ram operating within a feed trough. U.S. Pat. No. 4,681,146 to Liska teaches a method and apparatus for producing wood flakes using a rotating disc with cutting blades to process logs advanced and held against the disc by an infeed conveyor system. U.S. Pat. No. 4,161,972 to Hanaya discloses a further variation of this arrangement wherein logs to be processed are advanced against a rotating cutting disc.

The standard arrangement of the prior art has a major disadvantage in that it can be difficult to accurately control the advance of the logs into the rotating disc or drum with the result that chips or wafers of variable quality are produced. Logs for processing can be highly variable in shape and size and moving a collection of such logs at a controlled and predictable rate can be difficult and labour intensive. Also, as the cut must be made parallel with the wood grain, the logs must be introduced with their longitudinal axis at right angles to the axis of rotation of the cutting disc or drum. The logs therefore have to be cut to a pre-determined length which causes problems associated with fiber loss through saw kerfs and short log ends, handling problems, and increased capital and maintenance costs for conveyors and slasher decks to transport the cut logs.

SUMMARY OF THE INVENTION

Therefore, there exists a need for a waferizing apparatus that can handle logs or other wood pieces of variable length, diameter and quality without the aforementioned drawbacks and still produce a consistent, high quality wafer. The invention of the present application accomplishes this task by providing a rotary cutter disc that can be reciprocated along a linear axis corresponding to the axis of rotation of the disc. U.S. Pat. No. 4,681,145 to York discloses an apparatus for removing tree stumps that employs the idea of a linearly reciprocable rotary cutting disc, however, York does not address the problem of using such a structure for processing long logs. In the present invention, the cutting disc is advanced into a series of logs that extend from a log delivery conveyor arranged at right angles to the axis of rotation. The logs are clamped into position in the conveyor. By moving the rotary disc and holding the logs stationary during cutting, the log handling problems and fibre loss of the prior art are eliminated. Once the rotary cutter has converted the extended portion of the logs into wafers, the disc is retracted, the logs advance and are clamped in the conveyor so that the ends of the logs are extended for a further cutting pass of the rotary disc.

The present invention provides a novel waferizing apparatus for quickly and efficiently converting long logs into wafers.

Accordingly, the present invention is a long log waferizer for cutting logs into wafers comprising:

a base;

reciprocating means mounted to said base;

a movable frame on wheels adapted for linear reciprocating movement on said base under the control of said reciprocating means;

power means mounted to said movable frame;

rotary cutting means mounted to said movable frame, said rotary cutting means being driven by said power means; and log delivery means adapted to direct logs in front of said rotary cutter whereby said movable frame is moved to advance said rotary cutting means into said logs.

In a preferred embodiment of the long log waferizer, the rotary cutter is equipped with an electronic control system that uses an encoder mounted to the rotary cutter and a feed back sensor comprising a linear transducer mounted to the reciprocating means. The encoder senses the rotary speed of the rotary cutter and provides control signals to transducer at the hydraulic reciprocating means such that as the cutter slows down while cutting into a log, the transducer will cause the reciprocating means to slow the linear advance of the rotary cutter into the log a corresponding amount thereby maintaining a uniform thickness to the cut performed by the cutter.

Furthermore, an additional sensor is provided for the hydraulic reciprocating means to monitor the linear advance of the rotary cutter. Any excessive force over and above the force normally required to advance the cutter through wood is sensed resulting in automatic stopping of the linear advance to prevent mechanical damage.

A further feature of the present invention is a break-away anvil fixed to the movable frame of the waferizer. It occasionally happens that a knife or clamp is accidently left loose after a knife change. Major damage to the waferizer can occur if the loose knife or clamp strikes the conventional solid anvil. In the present apparatus, the break-away anvil is designed to shear and fold away to allow the loose knife or clamp to pass with minimal damage.

A still further feature of the present invention is the rim-less disc design of the rotary cutter. In the apparatus of the present invention, it is necessary that the cutting knives of the rotary cutter extend to the very edge of the disc allowing no space for a conventional rim. The rim-less disc of the present invention comprises a solid disc with radial slots that allow wafers to be discharged radially.

BRIEF DESCRIPTION OF THE DRAWINGS

A preferred embodiment of the long log waferizing apparatus of the present invention is illustrated in the following drawings in which.

DESCRIPTION OF THE PREFERRED EMBODIMENTS

Figure 1:
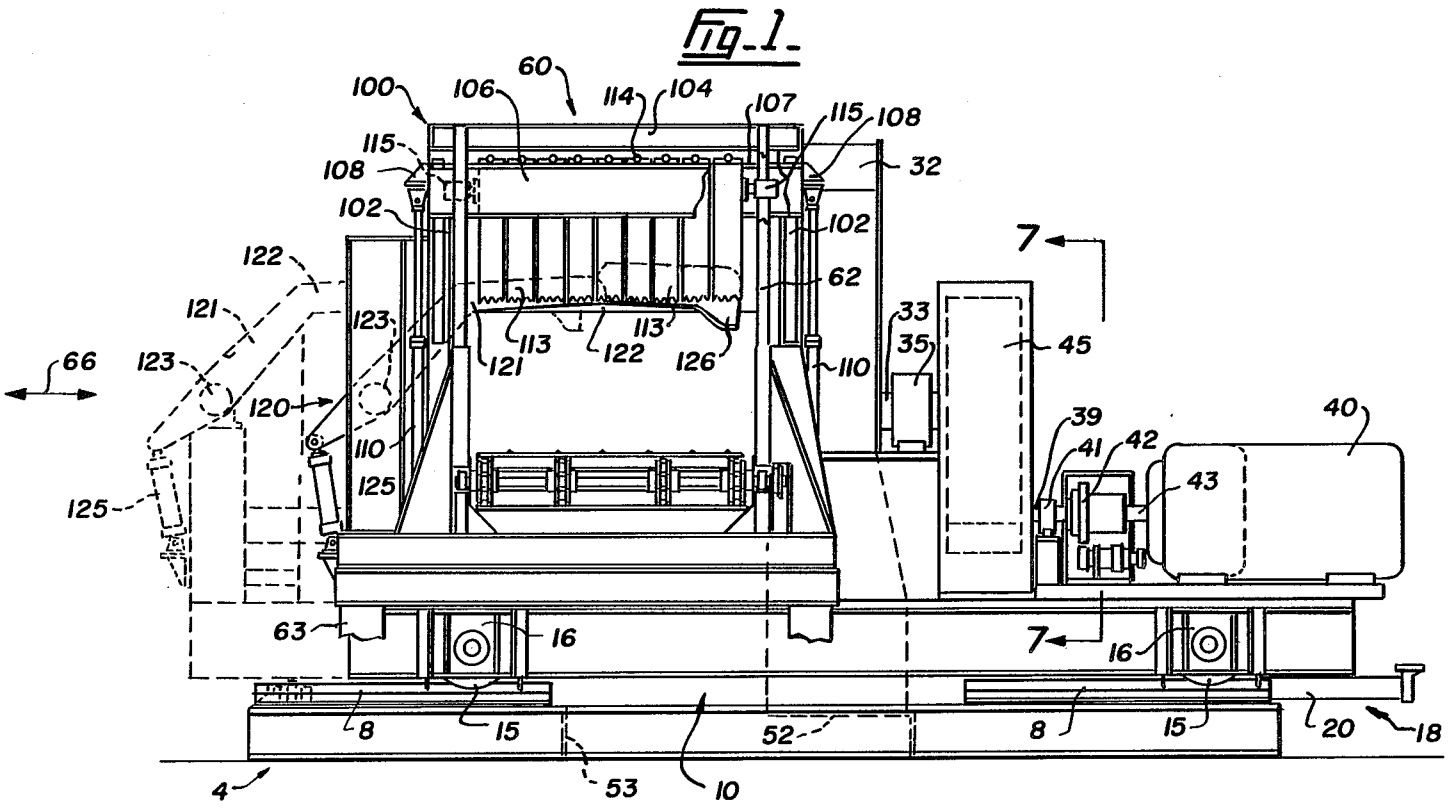
FIG. 1 is a side elevation view of the long log waferizer.
Figure 2:
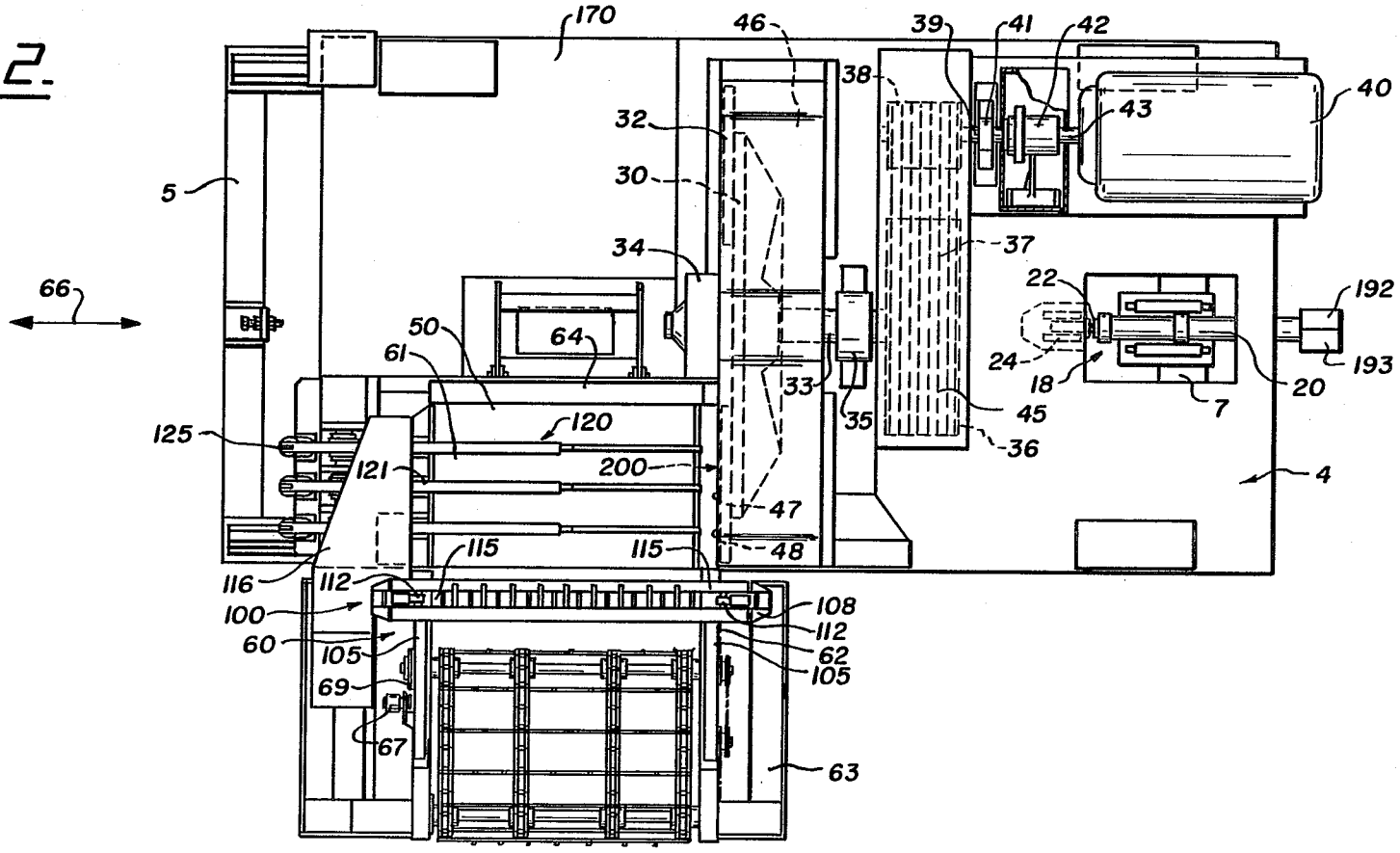
FIG. 2 is a plan view of the waferizer.
Figure 3:
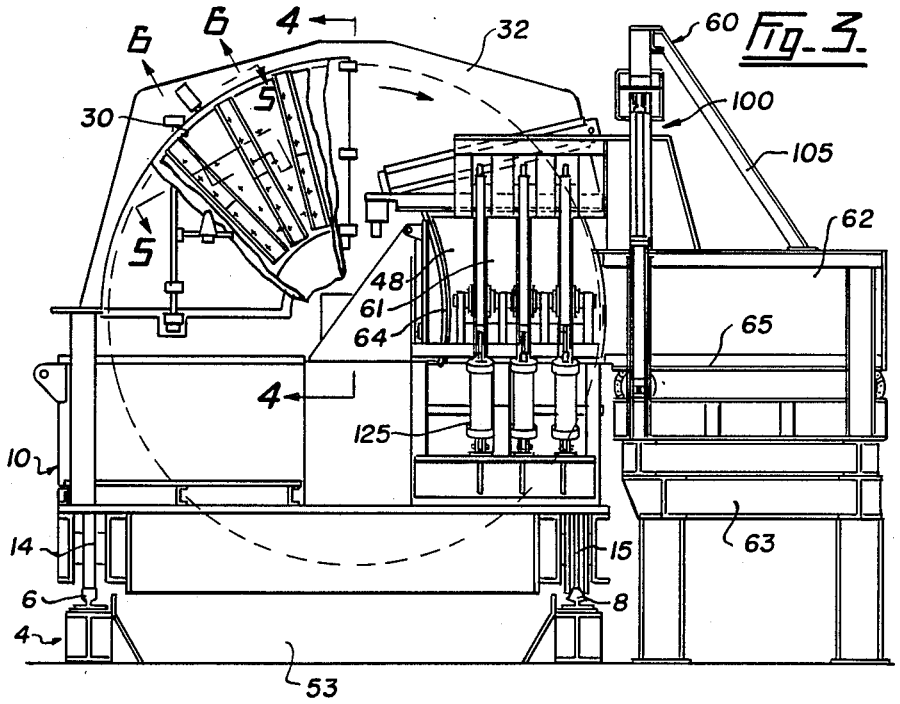
FIG. 3 is an end view of the waferizer showing the rotary cutter.

A preferred embodiment of a long log waferizer according to the present invention is shown in FIG. 1, 2 and 3. The device includes an immovable base 4 that is firmly anchored to the ground. As best shown, in FIGS. 2 and 3, base 4 comprises a pair of spaced rails 6 and 8 with spanning cross members 5 and 7 to brace the rails. These rails support a movable frame 10 on which rotary cutter 30, and power means 40 are mounted. Movable frame 10 rolls on sets of hardened wheels 14 and 15 mounted in conventional bearing blocks 16 on the underside of the frame. Wheels 14 have a flat edge and roll on flat rail 6. In contrast, wheels 15 have a V-shaped profile and roll on bevelled rail 8. V wheels 15 engaged on rail 8 provide lateral stability and guidance to ensure that movable frame 10 stays on the rails as it is reciprocated back and forth. A typical waferizer constructed according to the present invention would have a weight of approximately 60,000 lbs. and the wheeled frame 10 very much reduces the effort required to move the frame. Test have shown that the frame can be moved by a force of as little as 150 lbs making the frame and the rotary cutter 30 very responsive to movement by the reciprocating means such that the quality of wafers cut is more easily controlled.

The motion of the movable frame 10 is controlled by reciprocating means 18 mounted to cross member 7 at one end of base 4. In the preferred embodiment, reciprocating means 18 is a hydraulic cylinder 20 having an extendable piston arm 22 that is attached to the underside of frame 10 at bracket 24, as best shown in FIG. 2. Piston arm 22 is extended by hydraulic pressure causing movable frame 10 to advance on wheel sets 14 and 15 along rails 6 and 8.

In FIG. 1, there is shown a rotary cutter 30 centrally mounted on frame 10 within a protective shroud 32. Rotary cutter 30 is rigidly attached about a main shaft 33 by means of key 33a best shown in FIG. 4. Main shaft 33 is supported between bearing blocks 34 and 35. Just after bearing block 35, main shaft 33 is rigidly attached to sheave 36. Main shaft sheave 36 is connected by belts 37 to sheave 38 which is mounted to shaft 39 supported by bearings 41. Preferably, sheaves 36 and 38 with encircling belts 37 are covered by a protective shroud 45. Shaft 39 is connected through coupling assembly 42 to drive shaft 43 of power means 40. In the present embodiment, power means 40 comprises a large electric motor or the like that is mounted to movable frame 10. Power means 40 is used to rotate the rotary cutter 30 through the belt transmission system just described.

Rotary cutter 30 rotates within a slot 46 cut in movable frame 10. The cutting surface 47 of the cutter rotates by cutting window 48 in shroud 32 surrounding the cutter. Cutting window 48 is located on one side of the central rotation axis define by main shaft 33 and opens onto cutting area 50 into which logs to be processed are advanced. Except for cutting window 48, rotary cutter 30 is completely surrounded by shroud 32. As best shown in FIG. 1, shroud 32 defines an enclosure which communicates at 52 with a discharge duct 53 in base 4. Wafers cut from logs in the cutting area 50 travel through rotary cutter 30 and into the enclosure defined by shroud 32 where they are blown by the wind created by the cutter to discharge duct 53 for collection. Note that discharge duct 53 is wider than opening 52 so that the duct can accommodate the movement of movable frame 10 along rails 6 and 8 during the cutting process.

Log cutting area 50 is fed by log delivery means 60 that allow several parallel logs to be moved into the cutting area at a time. In the embodiment shown, the log delivery means consists of two portions, a first portion 61 directly in front of cutting window 48 that is an integral part of movable frame 10 and moves with the frame and a second portion that comprises a short chute section 62 mounted on a frame structure 63 that is firmly anchored to the ground and does not move with frame 10. As best shown in FIGS. 2 and 3, chute 62 extends at right angles to the direction in which movable frame 10 travels indicated by arrow 66. The base portion 61 has a flat bottom while the base of chute section 62 has a bed of conventional feeder chains extending between the side walls. Feeder chains are driven by motor 67 through a chain and sprocket drive arrangement. Cutting area 50 is provided with an end stop plate 64 to limit the distance that logs are extended into the cutting area. Preferably the back stop plate is covered with a replaceable wear resistant material.

It is understood that the chute section 62 shown in FIGS. 1, 2 and 3 can be constructed of any desired length by extending the support frame 63 and adding more feed chains that are connected to motor 67 using a chain and sprocket drive arrangement.

Figures 8, 9:
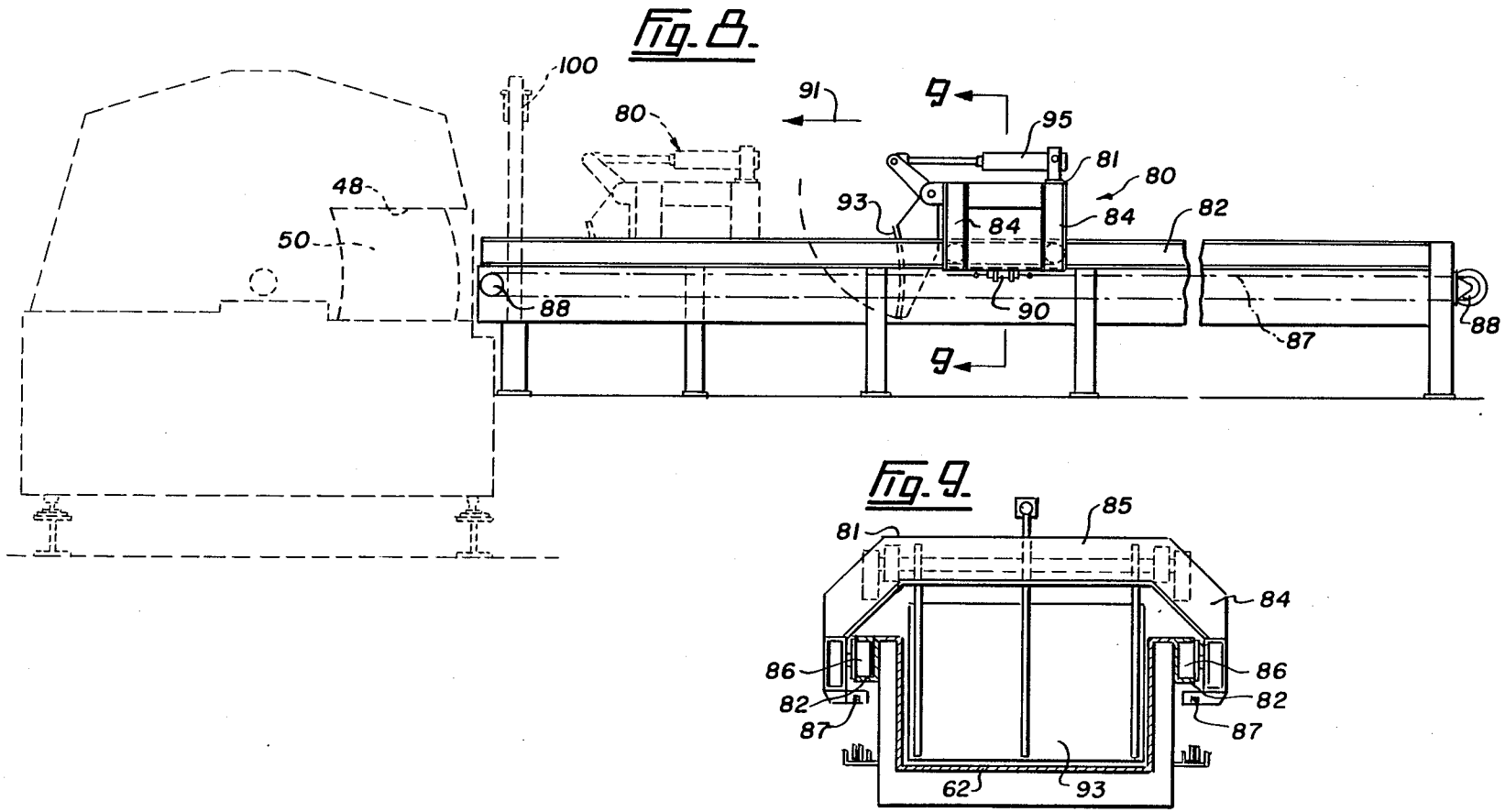
FIG. 8 is an elevation view of the log delivery chute for supplying the rotary cutter.
FIG. 9 is a section view taken along line 9—9 of FIG. 8 showing the pushing unit which may be used to advance logs in the log delivery chute.

Alternatively, as shown in FIGS. 8 and 9, chute section 62 can be extended and equipped with a pushing device 80 for moving logs into cutting area 50. Such an arrangement uses a chute with a solid base. Pushing device 80 comprises a main framework 81 adapted for movement along rails 82 mounted to the side wall of the chute. As best shown in FIG. 9, main framework 81 comprises a pair of straddling arms 84 that extend outwardly from central member 85 to straddle chute section 62. The ends of the straddling arms have wheel assemblies 86 for engagement in rails 82. As shown in FIG. 8, an endless loop wire or chain 87 rotates about wheels 88 at opposite ends of the chute section. Preferably both sides of the chute are equipped with this arrangement. Wheels 88 are driven by a motor (not shown). Endless loops 87 are attached to pushing device 80 at 90 such that, when the endless loops are driven by wheels 88, pushing device 80 will move along the chute section as indicated by arrow 91 and dashed line drawing 92.

The front end of the pushing device is equipped with a pivotable blade 93 that can rotated to fill the cross-sectional area of the chute. Blade 93 is used to push any logs in the chute so that they extend into cutting area 50. The position of blade 93 is controlled by hydraulic or air cylinder 95 mounted above the framework 81 of the pushing device and pivotally connected to the blade.

It is contemplated that the long log waferizer of the present invention will be made in at least two versions having different widths for the chutes of the log delivery means. For example, a four foot wide chute can be used or a six foot wide one. The latter version will be used for longer logs where the wider chute will more easily accommodate crooked logs.

Once the log delivery means has been used to position logs to be cut in the cutting area 50, it is necessary that the logs be held firmly in place while rotary cutter 30 is advanced against the logs. Referring now to FIG. 1, there is shown a clamping means 100 at the end of chute section 62 adjacent cutting area 50. This clamping means includes a framework having upstanding posts 102 and a cross member 104 that extends across the width of the chute section.

Bracing members 105, best shown in FIG. 3 extend downwardly from cross member 104. Between upstanding posts 102 and below cross member 104, there is a movable horizontal clamping bar 106 comprising a pair of beams 107 that overlap either side of upstanding posts 102. The ends of beams 107 are joined by bracket 108. Attached to the lower side of bracket 108 are biasing means 110 comprising hydraulic cylinders that act to raise and lower horizontal clamping bar 106 about upstanding posts 102. As best shown in FIG. 2, a pair of guide wheels 112 are mounted between beams 107 adjacent the inner side of each of the upstanding posts 102. Guide wheels 112 are adapted to roll along the inner side of the upstanding posts to guide up and down movement of horizontal clamping bar 106. Extending vertically downward from between beams 107 is a plurality of clamping bars 113 that are constrained from falling between beams 107 by flexible members 114. When the clamping bar 106 is lowered against logs extending into cutting area 50 through the action of cylinders 110, clamping bars 113 engage against the upper surfaces of the logs. Clamping bars 113 are free to move independently of each other such that the bars will conform to the shape of the logs in the chute. Once the bars are conformed to the shape of the logs, horizontal cylinders 115 mounted to upstanding posts 102 clamp the bars together, so that the bars will firmly hold the logs in place against the rollers of the log delivery means. Preferably, as shown, the ends of bars 113 are formed with teeth **113*a* to assist in their clamping action against the logs. It is conceivable that more than one clamping means 100** may be required in some cases.

Referring to FIGS. 2 and 3, it will be noted that immovable short chute section 62 has an extension 116 that extends over movable frame 10. Extension 116 forms a backstop facing plate to provide a bearing surface to assist in preventing movement of the logs as the rotary cutter is advance. The surface of extension 116 is preferably covered by replaceable wear strips.

The present embodiment of the long log waferizer also includes additional clamping means 120 that are attached to movable frame 10 and move with the frame. These clamping means are best shown in FIG. 1 and comprise a series of jointed arms 121 that extend over extension 116 and over cutting area 50. Each jointed arm has a first essentially L-shaped portion 122 pivotally mounted at 123 to movable frame 10. One end of portion 122 is attached to hydraulic cylinder 125 that controls the angle of the arm and therefore its clamping action. The opposite end of portion 122 is pivotally attached to second portion 126. Portion 126 is freely movable such that it will pivot to conform to the shape of logs in cutting area 50. Clamping means 120 provide clamping action for the protruding portion of the logs beyond clamping means 100 that is being cut by rotary cutter 30. As shown by dashed lines, jointed arms 121 are mounted to and move with frame 10. Since the arms do not extend all the way across cutting area 50 and they move with rotary cutter 30 there is no chance that the arms will come in contact with the cutter.

Figure 4:
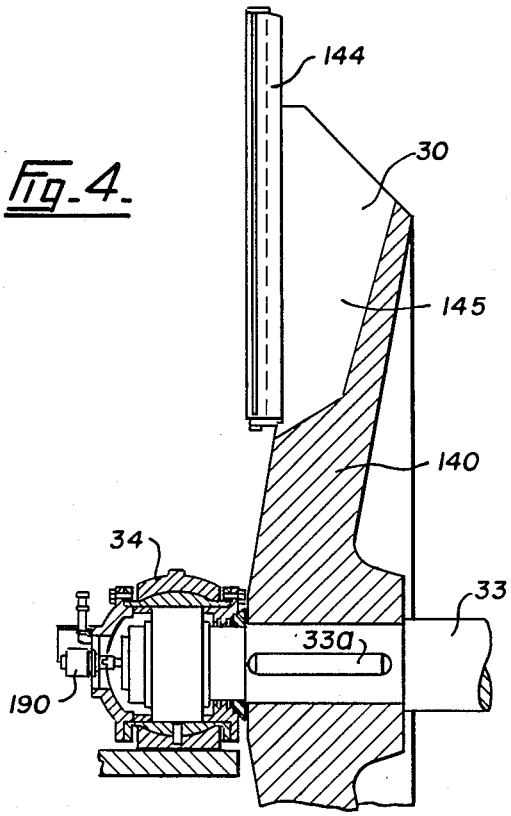
FIG. 4 is a section view through the rotary cutter taken along line 4—4 of FIG. 3.
Figure 5:
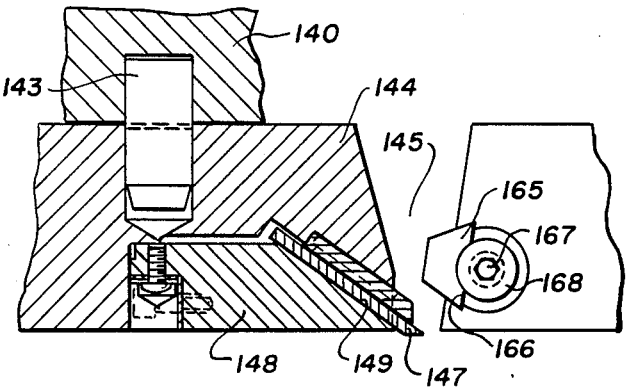
FIG. 5 is a section view through the rotary cutter taken along line 5—5 of FIG. 3 showing a detail view of the cutting knives and clamping bar.
Figure 6:
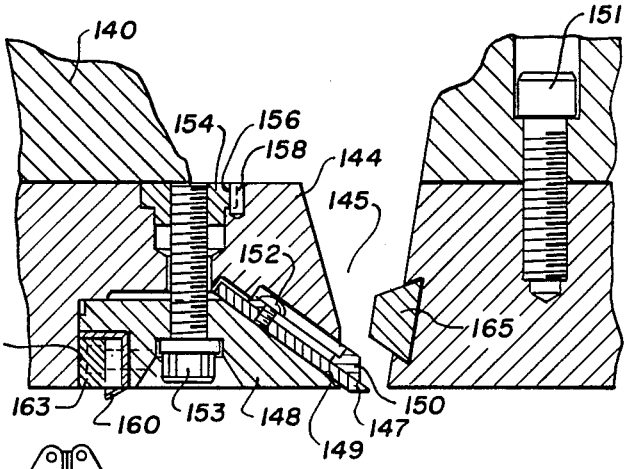
FIG. 6 is a section view through the rotary cutter taken along line 6—6 of FIG. 3 showing a detail view of the reactor bar.

FIG. 4 provides a cross-section view through the centre of rotary cutter 30. The rotary cutter comprises a central disc 140 that is mounted and locked on main shaft 33 by key **33*a*. Mounted to the disc are a plurality of knife carriers 144 with spaced openings 145 between the carriers communicating with adjacent openings in the disc. As shown in FIGS. 5 and 6 taken along lines 5–5 and 6–6 of FIG. 4, respectively, carriers 144 are mounted to disc 140 by a series of dowel pins 143 and bolts 151 extending from the disc and into the rear faces of the carriers. The rotary cutter of the present invention uses a new rimless disc design wherein the knife carriers 144 extend beyond the edge of rotatable disc 140** to which they are mounted. Conventional rotary cutters typically use a central disc that extends beyond the outer end of the knife carriers to form a rim about the periphery of the rotary cutter.

There is a conventional knife 147 associated with each opening 145 clamped to carrier 144. As shown particularly in FIG. 6, the knife clamp arrangement comprises a clamp 148 having an inclined surface 149 to abut knife 147. The knife 147 is mounted on a counter knife 150 located in position by fastener 152. A clamping bolt 153 engages threaded member 154 received within a recess 156 in carrier 144. A pin 158 is provided to prevent rotation of the threaded member 154. By tightening bolts 153 into threaded members 154 the clamp 148 is forced into contact with the assembly of the knife 147 and counter knife 150 to clamp the knife assembly to carrier 144.

Associated with each clamp 148 are a series of scoring knives 160 arranged at spaced intervals along the length of radially extending clamp. These scoring knives act to cut the wafers produced by knives 147 into strips. The scoring knives are held in recess 162 by clamping bar 163.

Figure 10:
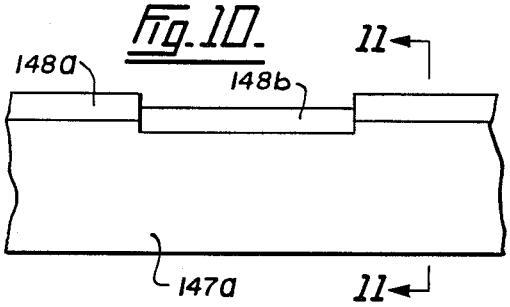
FIG. 10 shows a serrated cutting knife for use on the rotary cutter of the present invention.
Figure 11:
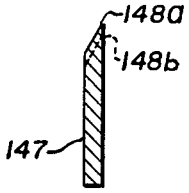
FIG. 11 is a section view through the cutting knife taken along line 11—11 of FIG. 10.

Alternatively, instead of using the combination of cutting knife 147 and scoring knife 160, serrated knives 147*a*, shown in FIG. 10, may be used. Serrated knife 147*a* comprises an elongated body having serrations on longitudinal edges. The serrations comprise projections 148*a* and recesses 148*b* having sharpened edges. Each projection and recess is of equal length corresponding to the required wafer length in the direction of the wood grain. When attached to knife carriers 144 in an identical manner as previously described, recesses 148*b* are closer to the face of the carrier than projections 148*a* as indicated in FIG. 11. Recesses 148*b* are positioned such that they extend a distance in front of the face of the carrier equal to the thickness of a wafer to be cut, and projections 148*a* extend a distance in front of recesses 148*b*. As the wafers are cut, the difference in levels between the serrations cause the wafers to break into the desired strips.

In openings 145 between the carrier 144, a reactor knife 165 is mounted in the adjacent carrier opposite each cutting knife. In the present invention, reactor knife 165 comprises a bevelled bar which is inserted into a dove-tailed slot 166 extending along the length of carrier 144 adjacent opening 145. As shown in FIG. 5, the reactor knife is held within slot 166 by a single fastener 167 and washer 168 at the outer periphery of the carrier 144. Such an arrangement makes replacement of the reactor knife easy and convenient as only a single fastener has to be removed to release the entire knife.

Figure 12:
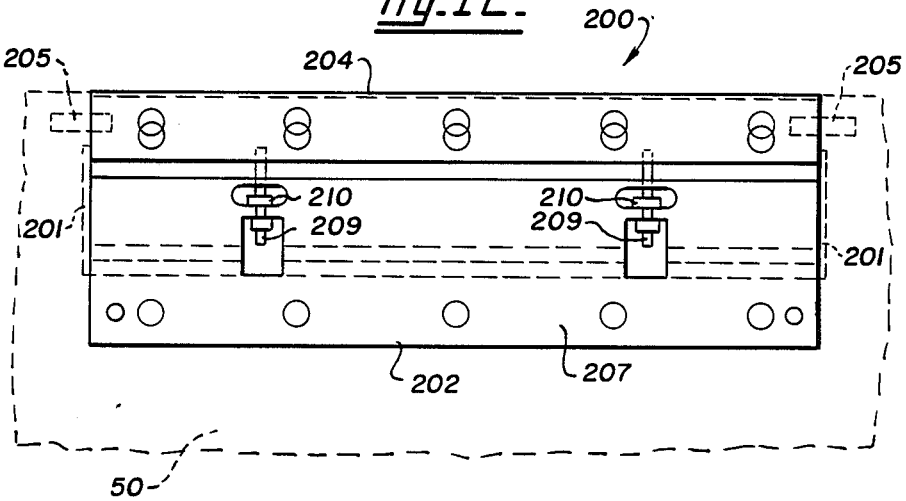
FIG. 12 shows the break-away anvil of the present invention.
Figure 13:
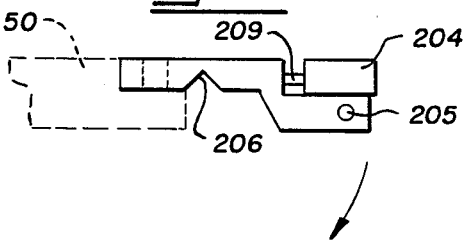
FIG. 13 is an end view of the break away anvil.

The rotary cutter performs its cutting operation through cutting window 48. Along the entire lower edge of the cutting window, the floor of cutting area 50 is shaped to create open area 201 into which breakaway anvil 200 is mounted. Breakaway anvil 200 acts to support logs at the point where they are cut and converted into wafers. FIG. 12 provides a detailed view of the break away anvil which includes a holder 202 firmly bolted to the floor of cutting area 50 along rear edge 207 and supported on frangible pins 205 adjacent cutting window 48 and the rotary cutter. Holder 202 supports anvil plate 204 adjacent the cutting window and includes adjustable threaded fasteners 209 that engage threaded openings 210 in the anvil plate. Adjustable threaded fasteners 209 allow anvil plate 204 to be moved back and forth on holder 202 to accurately position the anvil plate with respect to the rotary cutter. Locking nuts 210 are used to lock the anvil plate at a desired position. FIG. 13 provides an end view of the anvil and shows notch 206 formed on the underside of the anvil holder adjacent the holder's attachment to cutting area floor 50. Should a cutting knife of clamp be left accidentally loose after a knife change or other routine maintenance, it can do major damage to the waferizing apparatus upon striking the anvil plate 204. The frangible pins 205 of the break away anvil are designed to support the usual forces encountered as the rotary cutter cuts through wood. If, however, the anvil plate 204 is subjected to the striking force of a loose clamp or knife, the frangible pins 205 will break or shear away allowing holder 202 and anvil plate 204 to fold down out of the way about the hinge created by notch 206 into open area 201 to minimize damage to the entire apparatus.

To ensure consistent high quality wafer production, the apparatus of the present invention is equipped with a specialized electronic control system. This system comprises:

(1) an encoder 190 mounted to rotary cutter 30 at the end of main shaft 33 directly in front of bearing 34 as shown in FIG. 4. Encoder 190 is a conventional off-the-shelf unit that monitors the rotational position of rotary cutter 30.

(2) a feed back sensor comprising a linear displacement transducer 192 mounted on the reciprocation means 18. Transducer 192 is a conventional off-the shelf-unit which monitors the position of the reciprocating means 18.

(3) an electronic motion controller mounted remotely to the main apparatus. The controller is an off-the-shelf unit which utilizes specialized machine control software which is specific to this apparatus.

The software contains PID (proportional, integral, derivative) motion control, diagnostic and maintenance algorithms required to ensure a constant wafer thickness and rotary cutter horsepower. The reciprocating means 18 is positioned accurately to within 1/1000 of an inch relative to the rotational position of the rotary cutter 30 accurate to 0.045 degrees. The system updates the reciprocating means 18 position every milliseconds. Therefore, as the rotary cutter slows down in a heavy cut, the system will slow the advancement of the reciprocating means a proportional amount. The electronic control system prevents the cutter from being advanced into the logs at a rate that overcomes the cutter's ability to produce high quality wafers. In addition, the electronic control system provides a direct human interface with the apparatus such that the water thickness can be infinitely adjusted via a large number of off-the-shelf computer interface devices.

In addition, reciprocating means 18 is provided with a further sensor 193 to control the advance of movable frame 10. Sensor 193 monitors the advance of the frame and thus the rotary cutter. If an excessive force over and above the force normally required to advance a rotary cutter with reasonably sharp knives is detected by sensor 193, the linear advance of the reciprocating means is automatically stopped to prevent damage to the apparatus.

Figure 7:
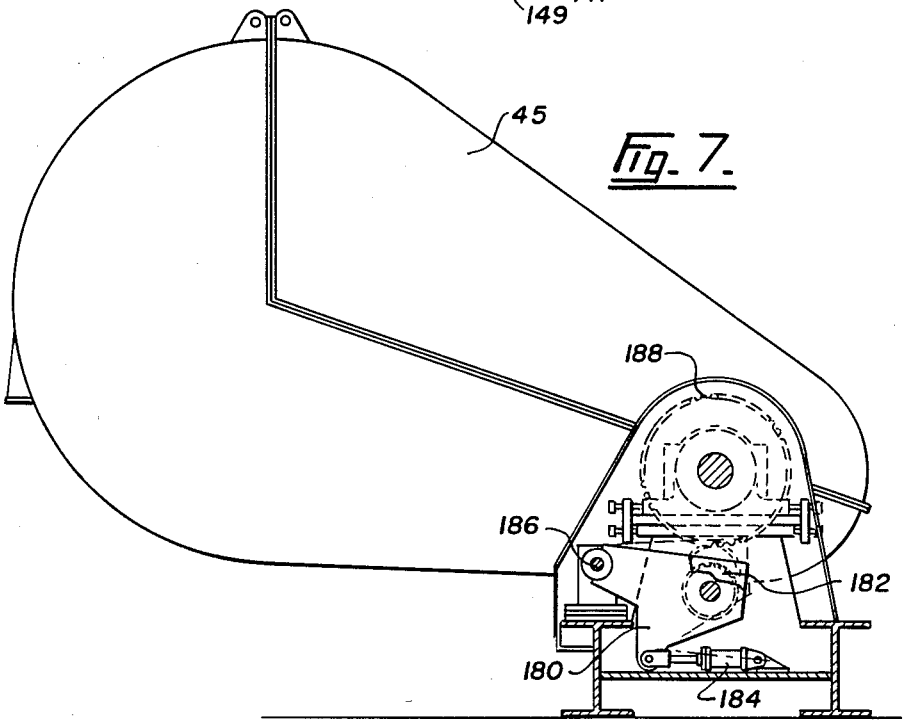
FIG. 7 is a section view taken along line 7—7 of FIG. 1 showing the apparatus for advancing the rotary cutter when performing maintenance.

Periodically, it is necessary to perform routine maintenance on rotary cutter 30 chiefly involving replacing the various knives since sharp cutting edges are important in maintaining good quality wafers. Accordingly, as shown in FIGS. 2 and 3, the long log waferizer of the present application is provided with an access platform 170 atop movable frame 10. Shroud 32 surrounding the rotary cutter is provided with inspection openings for access to the equipment of the cutter. The rim-less design of the present cutter makes turning the disc by hand for access to the carriers during routine maintenance difficult as there is no rim to grasp. In this regard, means are provided for slowly rotating the rotary cutter during maintenance as illustrated in FIG. 7. The rotating means comprises a pivoting arm 180 having an attached hydraulic motor to drive pinion gear 182. Hydraulic cylinder 184 is used to pivot arm 180 about hinge 186 such that pinion gear 182 can move up and down to selectively engage gear 188 mounted on drive shaft 43. When the two gears are engaged, the hydraulic motor acts to slowly rotate the rotary cutter as required.

The overall operation of the long log waferizer of the present invention through one operating cycle is as follows:

A group of logs within the chute of the log delivery means are advanced into log cutting area 50 until the logs abut againsat back plate 64. The vertical clamping arms 113 and jointed clamping arms 121 are lowered to firmly hold the logs in place. Hydraulic cylinder 20 is then extended to advance moveable frame 10 along rails 6 and 8 thereby moving rotary cutter 30 powered by motor 40 through the logs and converting the logs into wafers. When cutter 30 has converted the protruding portion of the logs into wafers, movable frame 10 is retracted to its starting position, the clamping means are released, and the logs in the chute are advanced and then clamped ready for another cycle of operation.

A prototype waferizer was built according to the present invention using a 750 H.P. motor operating at 1200 RPM to drive the rotary cutter at 380 RPM. Using the prototype to create flakes having a thickness of 0.026 inches, the following operation times were recorded:

Operating at this speed, and assuming a conversion efficiency of 0.6 from solid wood to wafers, the prototype was capable of waferizing 40,000 to 60,000 lbs of wood per hour.

The long log waferizer of the present invention provides a quick and efficient apparatus for converting portions of a number of logs into wafers in a single operating cycle of the unit. Furthermore, the present apparatus is able to provide uniform quality wafers by incorporating feedback sensing equipment to control the advance of the rotary cutter through the logs.

We claim:

1. A long log waferizer for cutting logs into wafers comprising:

a base;

reciprocating means mounted to said base;

a movable frame on wheels adapted for linear reciprocating movement on said base under the control of said reciprocating means;

power means mounted to said movable frame;

rotary cutting means mounted to said movable frame, said rotary cutting means being driven by said power means; and log delivery means adapted to direct logs in front of said rotary cutter whereby said movable frame is moved to advance said rotary cutting means into said logs.

2. A long log waferizer as claimed in claim 1 in which said base is equipped with rails and said movable frame is equipped with rotatable wheels that travel along said rails.

3. A long log waferizer as claimed in claim 2 in which at least one set of wheels moving along a rail have a V cross-section periphery adapted to engage said rail to control lateral movement of said movable frame with respect to said rail, the remaining sets of wheels having a flat periphery.

4. A long log waferizer as claimed in claim 1 in which said reciprocating means comprises a hydraulic cylinder acting between said base and said movable frame.

5. A long log waferizer as claimed in claim 4 in which said hydraulic cylinder is fitted with a sensor to control the advance of said cylinder, said sensor stopping the advance of said cylinder upon detection of an excessive force.

6. A long log waferizer as claimed in claim 1 in which said log delivery means comprises;

a chute having side walls and a base;

conveying means for advancing logs along said chute; and clamping means for holding down and controlling said logs as they are cut by said rotary cutting means.

7. A long log waferizer as claimed in claim 6 in which said conveying means comprises a series of conventional feeder chains mounted across said base driven by a sprocket and chain drive system.

8. A long log waferizer as claimed in claim 6 in which said clamping means comprises:

a frame; and a set of independently movable vertical bars positioned in said frame above said chute, said frame having biasing means to move said frame up and down in order to clamp logs against the base of said chute, the independently movable bars configuring themselves to the shape of the logs underneath.

9. A long log waferizer as claimed in claim 8 including clamping means for moving said movable bars together.

10. A long log waferizer as claimed in claim 8 in which said biasing means is a hydraulic cylinder.

11. A long log waferizer as claimed in claim 6 in which said clamping means comprises a plurality of jointed arms extending above said chute, each jointed arm having a first pivotable portion controlled by a fluid cylinder and second portion pivotally joined to an end of said first portion such that said second portion is free to pivot and conform to the shape of logs

12. A long log waferizer as claimed in claim 1 in which said rotary cutting means comprises:

a central rotatable disc;

knife carriers mounted on the disc and extending radially of said disc;

spaced openings between the carriers;

openings in said disc communicating with openings in said carriers;

a cutting knife associated with each opening; and a cutting knife clamp bolted to the carrier to clamp each cutting knife in position, said cutting knives and said cutting knife clamps extending at least to the periphery of the disc.

13. A long log waferizer as claimed in claim 12 including a reactor knife in each opening opposite each of said cutting knives.

14. A long log waferizer as claimed in claim 13 in which each of said reactor knives is located in a dovetail slot and held in place by a threaded fastener at the outer periphery of said rotary cutter.

15. A long log waferizer as claimed in claim 12 including a series of scoring knives removable mounted in each of said cutting knife clamps.

16. A long log waferizer as claimed in claim 12 in which each cutting knife is a double-edged knife formed with a plurality of serrations on a longitudinal edge.

17. A long log waferizer as claimed in claim 12 having means for slowly rotating said rotary cutter when performing knife changes comprising an auxiliary motor;

a first wheel driven by said auxiliary motor, said wheel being mounted to a pivoting arm;

a second wheel mounted to the axis of rotation of said rotary cutter or to the axis of rotation of said drive motor;

said pivoting arm being movable to an engaged position such that said first wheel drives said second wheel to rotate said rotary cutter.

18. A long log waferizer as claimed in claim 1 including a break-away anvil adjacent said rotary cutter.

19. A long log waferizer as claimed in claim 1 including an electronic control system comprising:

an encoder mounted to said rotary cutter to monitor rotating speed; and a feed back sensor mounted to said reciprocating means and connected to said encoder, said feed back sensor controlling said reciprocating means such that as said cutter slows down while cutting into a log, said encoder will signal said sensing unit to cause said reciprocating means to slow the linear advance of said rotary cutter into said log a corresponding amount thereby maintaining a uniform quality to the cut performed by said cutter.

20. A long log waferizer as claimed in claim 19 in which said electronic control system is controlled by software, the linear advance speed of said reciprocating means being adjustable by changing software parameters.

* * * * *